US005895287A

United States Patent [19]

Seto et al.

[11] Patent Number: 5,895,287

[45] Date of Patent: Apr. 20, 1999

[54] FLAT CABLE CONNECTOR

[75] Inventors: Masashi Seto, Zama; Shinsuke Kunishi, Hadano; Minoru Fukushima, Yokohama, all of Japan

[73] Assignee: Molex Incorporated, Lisle, Ill.

[21] Appl. No.: 08/647,501

[22] Filed: May 14, 1996

[30] Foreign Application Priority Data

Jun. 8, 1995 [JP] Japan ..... 7-006643

[51] Int. Cl.[6] ..... H01R 9/07

[52] U.S. Cl. ..... 439/495; 439/260; 439/725

[58] Field of Search ..... 439/77, 67, 492, 439/493, 495, 496, 260, 635, 725, 729

[56] References Cited

U.S. PATENT DOCUMENTS

| | | | |
|---|---|---|---|
| 4,477,137 | 10/1984 | Ayer . | |
| 4,630,874 | 12/1986 | Renn et al. . | |
| 4,639,063 | 1/1987 | Mueller . | |
| 4,936,792 | 6/1990 | Onoue et al. | 439/329 |
| 4,944,690 | 7/1990 | Imai | 439/492 |
| 5,201,661 | 4/1993 | Li | 439/260 |
| 5,458,506 | 10/1995 | Yamaguchi et al. | 439/495 |
| 5,580,272 | 12/1996 | Yamaguchi et al. | 439/260 |

FOREIGN PATENT DOCUMENTS

| | | |
|---|---|---|
| 0 618 643 A2 | 10/1994 | European Pat. Off. . |
| 0 619 624 A2 | 10/1994 | European Pat. Off. . |
| 2-86080 | 3/1990 | Japan . |
| 3-163771 | 7/1991 | Japan . |
| 4-61883 | 5/1992 | Japan . |
| 7-22129 | 1/1995 | Japan . |

*Primary Examiner*—Hien Vu
*Attorney, Agent, or Firm*—Stephen Z. Weiss

[57] ABSTRACT

An electrical connector is provided for terminating a flat cable. The connector includes a housing mounting a plurality of terminals in a generally parallel array. The housing has opposite sides and a front end, with an opening between the sides for receiving an end of the flat cable in engagement with contact portions of the terminals. A pressure member is rotatably mounted on the housing for movement between a first position allowing insertion of the flat cable into the opening and a second position pressing conductors of the flat cable against the contact portions of the terminals. Overhanging extensions project inwardly from the opposite sides of the housing to prevent release of the flat cable from the connector in the event undesired external forces are applied to the cable which would tend to bias the pressure member toward its first position.

9 Claims, 5 Drawing Sheets

FLAT CABLE CONNECTOR

FIELD OF THE INVENTION

This invention generally relates to the art of electrical connectors and, particularly, to an electrical connector for terminating a flat cable, such as a flat flexible cable, printed circuit board or the like, without requiring any insertion force.

BACKGROUND OF THE INVENTION

There are a wide variety of zero insertion force electrical connectors particularly adapted for terminating flat cables, such as flexible flat cables, flexible printed circuit boards and the like. These electrical connectors conventionally have a housing mounting a plurality of terminals in a generally parallel array. An actuator, such as a pressure member, is used to press the flexible flat cable, flexible printed circuit board or the like against contact portions of the terminals.

Heretofore, some actuators have been designed to be pushed in and pulled out of the connector housings. Such designs require the application of insertion forces to the flat cables. In addition, such designs have inevitably resulted in an increase in the overall size of the connectors.

Consequently, some zero insertion force electrical connectors for flat cables have been designed with actuators or pressure members which are rotatably or pivotally mounted on the housing for movement between first, open positions allowing free insertion of the cables into the connector housings, and second, closed positions for clamping the flat cables against the contact portions of the terminals.

One of the problems with prior connectors having rotatable actuators or pressure members is the tendency of moving the pressure member back toward its open position when undesired external forces are applied to the flexible flat cable. The flat cable tends to raise and rotate the pressure member, thereby releasing the flat cable from the connector. The present invention is directed to solving this problem and preventing undesired releasing or decoupling of the flat cable from the connector when certain external forces are applied to the cable.

SUMMARY OF THE INVENTION

An object, therefore, of the invention is to provide a new and improved zero insertion force electrical connector for flat electrical cables, of the character described.

In the exemplary embodiment of the invention, the electrical connector includes a dielectric housing mounting a plurality of terminals in a generally parallel array transversely of the connector. The housing has opposite sides and a front end, with an opening between the sides for receiving an end of the flat cable in engagement with contact portions of the terminals. A pressure member is rotatably mounted on the housing for movement between a first position allowing insertion of the flat cable into the opening and a second position pressing conductors of the flat cable against the contact portions of the terminals. Generally, stop means are provided on the housing to prevent release of the flat cable from the electrical connector in the event undesired external forces are applied to the cable which would tend to bias the pressure member back toward its first position.

More particularly, the stop means are provided by overhanging extensions projecting inwardly from the opposite sides of the housing. The pressure member includes an actuating portion having a width sized to fit between the overhanging extensions at the opposite sides of the housing.

A pair of pivots rotatably mount the pressure member on the housing at opposite sides of the pressure member. The pivots are located rearwardly of the overhanging extensions. Lastly, the pressure member includes a stepped lower surface at the front thereof defining a generally triangular space between the pressure member and the flat cable when the pressure member is in its second position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
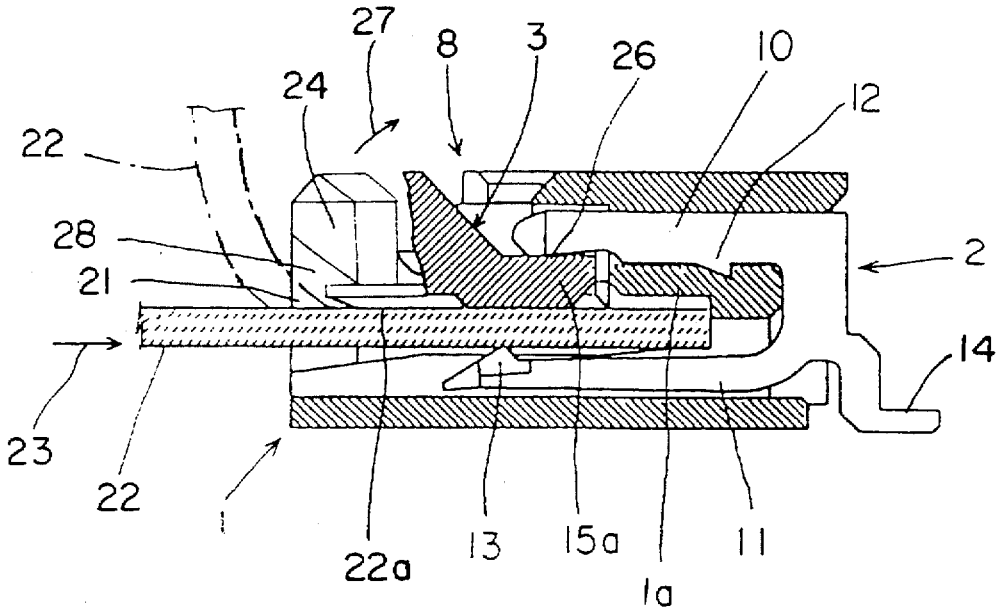
FIG. 1 is a front-to-rear vertical section through the flat cable connector of the invention, with the front of the pressure member broken away.

Referring to the drawings in greater detail, FIG. 1 shows a first embodiment of a flexible flat cable connector according to the invention. The connector includes a housing 1 mounting a plurality of terminals 2 in a generally parallel array. The housing rotatably mounts an actuator or cable pressure member 3. Details of the housing are shown in FIGS. 2–4, and details of the cable pressure member are shown in FIGS. 5–10.

Figure 2:
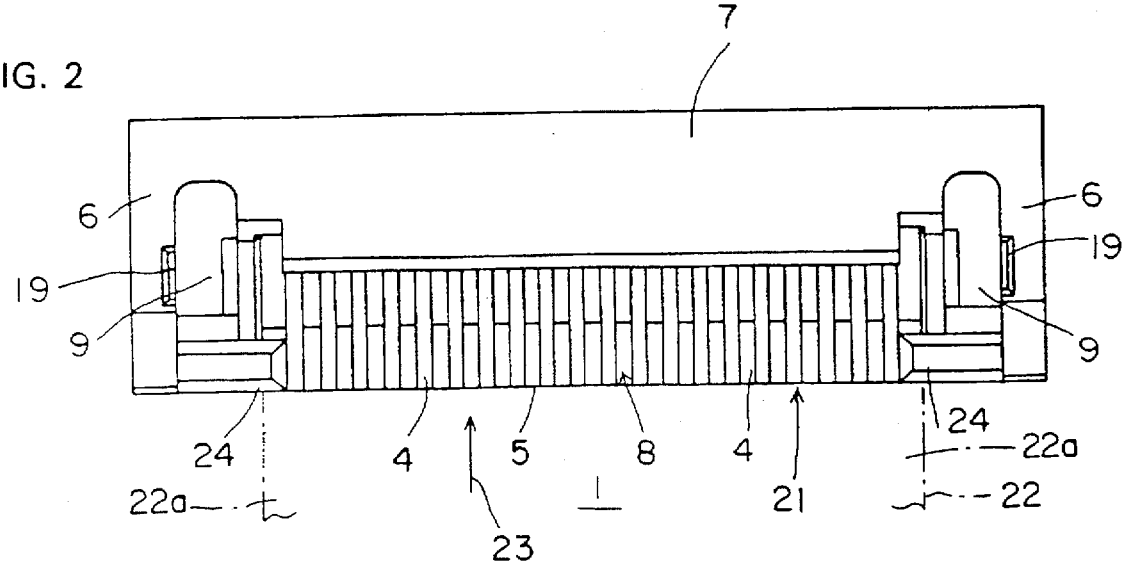
FIG. 2 is a top plan view of the housing of the connector.
Figure 3:
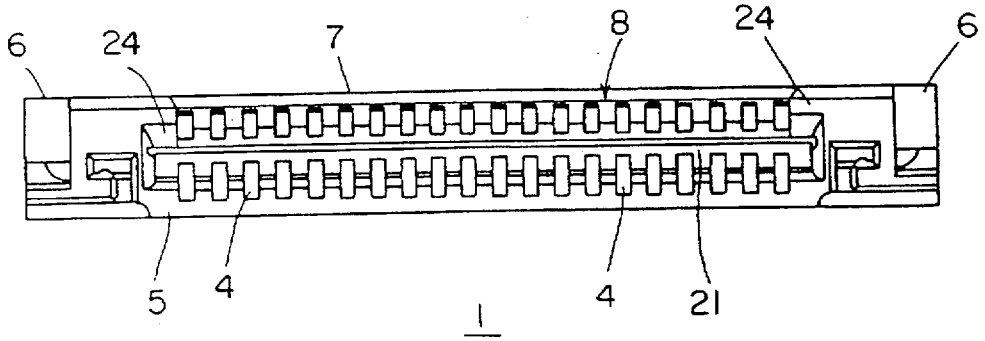
FIG. 3 is a front elevational view of the housing of the connector.
Figure 4:
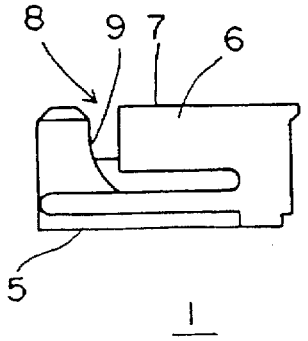
FIG. 4 is a side elevational view of the housing of the connector.
Figure 5:
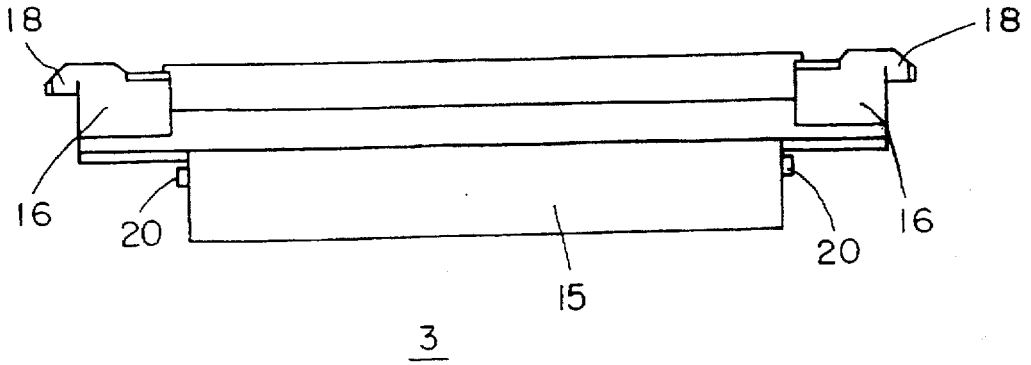
FIG. 5 is a top plan view of the pressure member.
Figure 6:
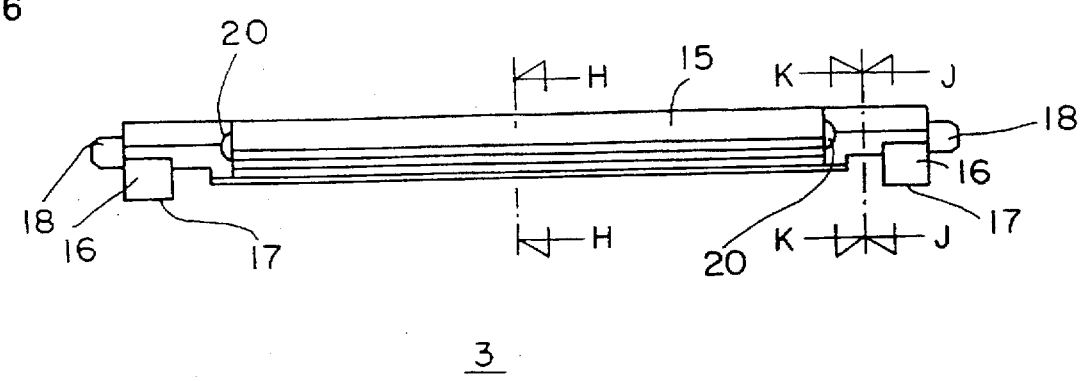
FIG. 6 is a front elevational view of the pressure member.
Figure 7:
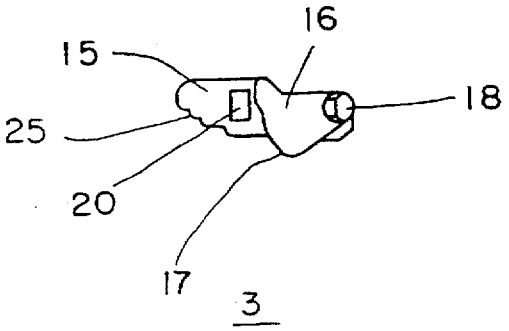
FIG. 7 is a side elevational view of the pressure member.

Referring to FIGS. 2–4 in conjunction with FIG. 1, housing 1 is unitarily molded of dielectric material such as plastic or the like. The housing includes a base 5 having a plurality of terminal slots 4 formed therein, opposite side walls 6 molded integrally to opposite lateral edges of base 5, and a top wall 7 extending transversely between opposite side walls 6. Each side wall has a cam slot or track 9 facing upwardly toward top wall 7. As described in greater detail hereinafter, cable pressure member 3 has a counter cam on each opposite side thereof for cooperating with cam slot 9 for guiding the cable pressure member between its rotatable positions.

As seen in FIGS. 2 and 3, top wall 7 extends short of the front end of housing 1, thereby leaving a space or opening 8 at the front of the housing. The opening coincides with a cable insertion opening, generally designated 21, into which a flexible flat cable 22 can be inserted in the direction of arrow 23 (FIG. 3). Lastly, housing 1 includes stop means in the form of a pair of overhanging extensions 24 projecting inwardly from opposite side walls 6 and overhanging the opposite edges 22*a* of flexible flat cable 22 as best seen in FIG. 3.

Each terminal 2 is stamped from sheet metal material in a bifurcated shape as best seen in FIG. 1. The bifurcated shape defines a relatively short upper support leg 10 and a relatively long lower contact leg 11. Support leg 10 has a barb 12, and the terminal is fixed in a respective one of the terminal slots 4 by barb 12 of support leg 10 biting into an intermediate shelf 1*a* of the housing. Contact leg 11 has a contact portion 13 projecting from the free end of the leg upwardly toward support leg 10. An L-shaped soldering tail 14 extends rearwardly of the terminal and outwardly of housing 1. The bottom of the L-shaped soldering tail 14 is flush with the bottom surface of base 5 of the housing for soldering to a circuit trace on an appropriate printed circuit board.

Referring to FIGS. 5–10 in conjunction with FIGS. 1–4, cable pressure member 3 is unitarily molded of dielectric material, such as plastic or the like. The pressure member includes a major flat plate 15 which is wide enough to span the opening 8 at the front of housing 1. Triangular flanges 16 are molded integrally at opposite sides of flat plate 15. Each triangular flange 16 has a counter cam 17 at the front thereof. Each triangular flange 16 is positioned so that its counter cam 17 confronts the cam slot or track 9 (FIG. 4) in a respective one of the side walls of the housing.

Figure 8:
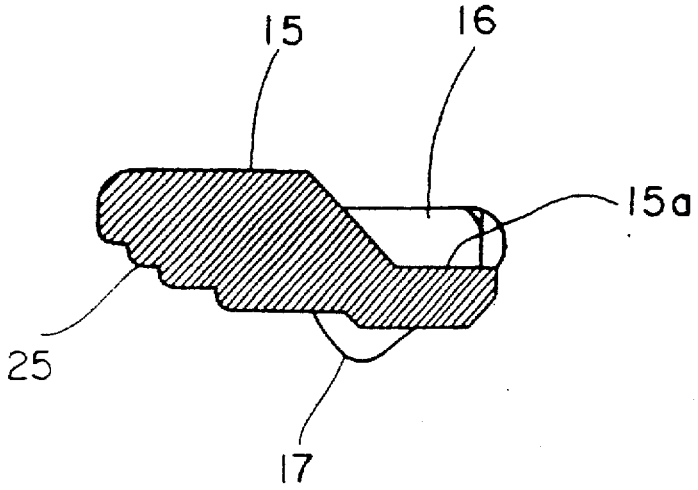
FIG. 8 is an enlarged vertical section taken generally along line H—H in FIG. 6.
Figure 9:
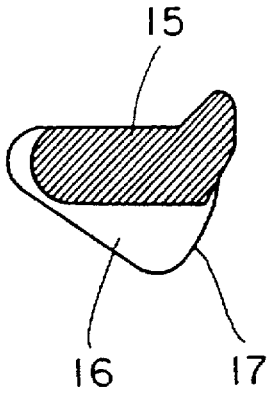
FIG. 9 is an enlarged vertical section taken generally along line K—K in FIG. 6.
Figure 10:
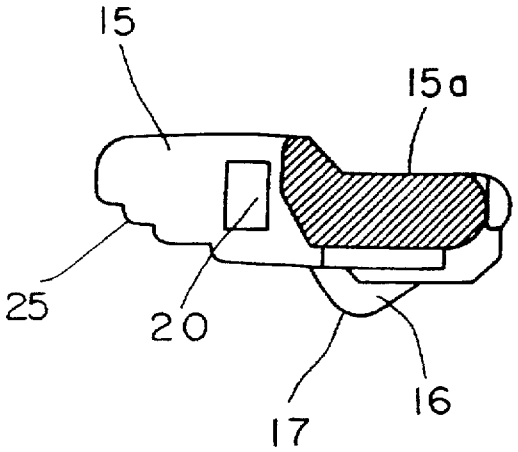
FIG. 10 is an enlarged vertical section taken generally along line J—J in FIG. 6.

Major flat plate 15 of cable pressure member 3 has a width sized to fit in the space between the opposite overhanging extensions 24 of housing 1 as the cable pressure member moves from a first open position allowing insertion of flat cable 22 into opening 8 in the housing, and a second closed position pressing conductors of the flat cable against contact portions 13 of terminals 2 as shown in FIG. 1. As seen in FIGS. 8 and 10, major flat plate 15 of cable pressure member 3 has a stepped lower surface 25 at the front thereof. In addition, the cable pressure member has projections 18 (FIGS. 5–7) projecting outwardly of its opposite sides. Each projection 18 fits into an L-shaped slot 19 (FIG. 2) in the inner surface of one of the side walls 6 of the housing. The cable pressure member also has rounded side projections 20 which form detents to snap over the inside edges of overhanging extensions 24 when the pressure member is moved between its open and closed positions.

Cam slots or tracks 9 on housing 1 and counter cams 17 on cable pressure member 3 cooperate functionally to guide the cable pressure between its rotatable positions. Specifically, when the cable pressure member is moved toward its closed position shown in FIG. 1, a rear end 15*a* (FIG. 8) of the cable pressure member moves under a comb-like support arrangement defined by the bottom surfaces 26 (FIG. 1) of support legs 10 of terminals 2. By this action, flat cable 22 is pinched between the undersurface of the cable pressure member and contact portions 13 of terminals 2.

Referring back to FIG. 1 wherein flexible flat cable 22 has been inserted into the connector, assume that the flat cable is pulled upwardly as shown in broken lines by undesired external forces applied to the cable. In a conventional electrical connector structure, the cable pressure member would be rotated toward its open position in the direction indicated by arrow 27. However, according to the concepts of the present invention in the electrical connector structure shown herein, the flat cable 22 will move or bend the cable pressure member upwardly only a small degree until the flat cable is stopped by the overhanging extensions 24 extending inwardly from the opposite sides of the housing. Further upward pulling on the cable is prevented and the cable pressure member will not move toward its open position. Therefore, undesired release or decoupling of the flat cable from the connector is stopped. It can be seen that a triangular space 28 (FIG. 1) is formed beneath overhanging extensions 24 which, in effect, defines the limit of movement of the flat cable in the event that undesired upward forces are applied thereto.

Figure 11:
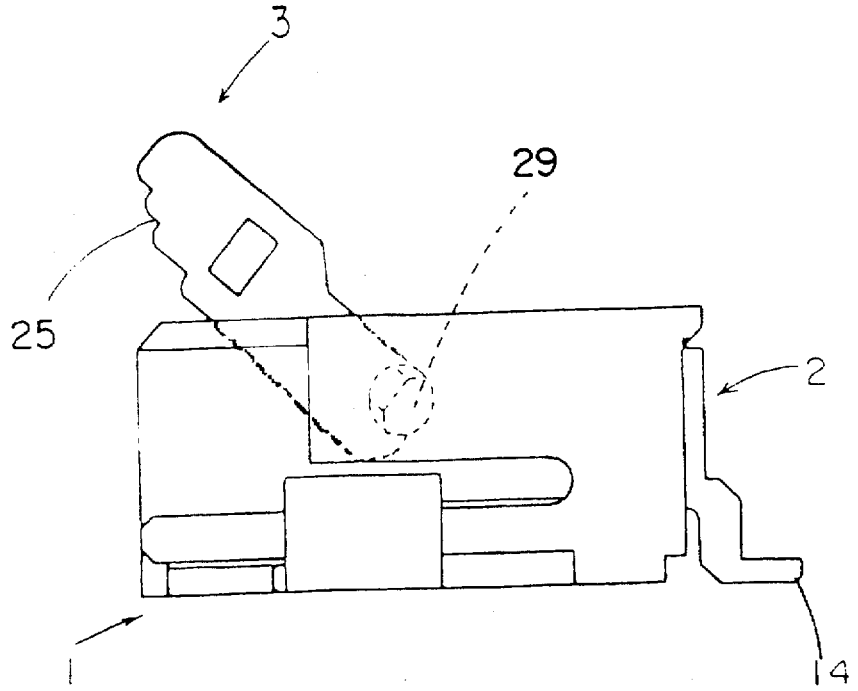
FIG. 11 is a side elevational view of another embodiment of a flat cable connector, with the pressure member in its open position.
Figure 12:
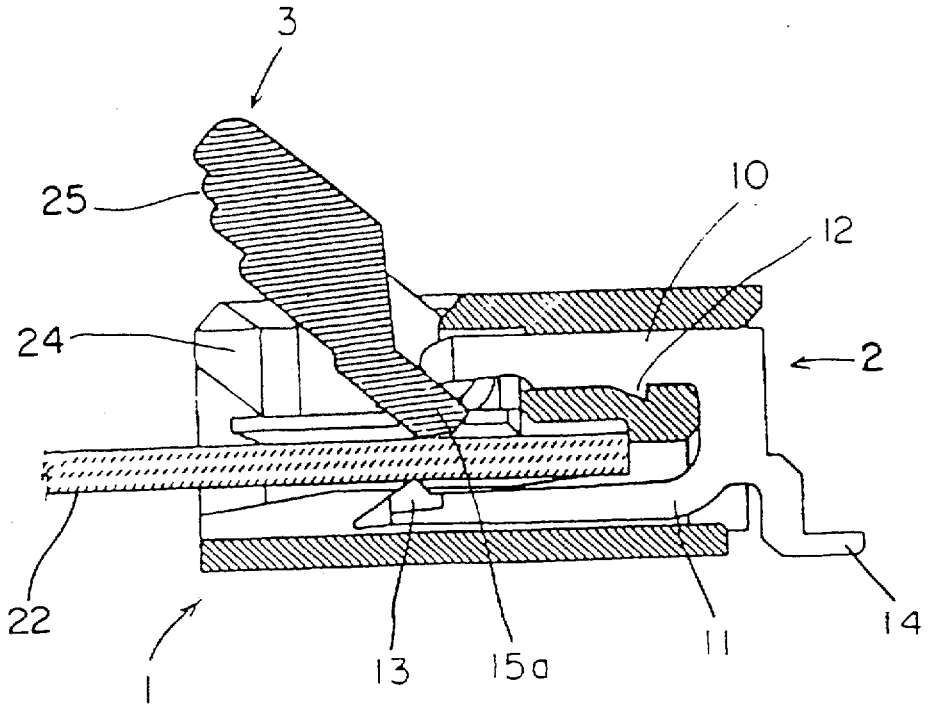
FIG. 12 is a front-to-rear vertical section through the flat cable connector of FIG. 12.

In the electrical connector described above in relation to the embodiment of FIGS. 1–10, housing 1 is provided with cam slots 9 and cable pressure member 3 is provided with counter cams 17 for assuring a smooth rotation and displacement of the cable pressure member toward its closed, cable pinching position. However, such cam means can be omitted as shown in the embodiment of FIGS. 11 and 12. In other words, pressure member 3 in FIGS. 11 and 12 is movable from its open position, as shown, about pivots 29 between opposite sides of the cable pressure member and the insides of the side walls of the housing, but no cam means are provided.

Lastly, it should be understood that the supporting undersurfaces 26 of the support legs 10 of terminals 2 can be readily replaced by a transversely extending portion of housing 1. Still further, soldering tails 14 of terminals 2 may comprise pin-like projections for insertion into appropriate holes in a printed circuit board and for soldering to appropriate circuit traces on the board and/or in the holes.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for a flat cable, comprising:

a housing mounting a plurality of terminals in a generally parallel array, the housing having a cammed slot in opposite side walls and a front end with an opening between the sides for receiving an end of the flat cable in engagement with contact portions of the terminals;

a pressure member rotatably mounted on the housing and forced against the cammed slot for movement between a first position allowing insertion of the flat cable into the opening and a second position pressing conductors of the flat cable against the contact portions of the terminals; and stop means on the housing comprising overhanging extensions projecting inwardly from the opposite side walls of the housing and said pressure member positioned in said cammed slot between said front end and said overhanging extensions and adapted to engage edges of the end of the flat cable preventing release of the flat cable from the electrical connector in the event undesired external forces are applied to the cable which would tend to bias the pressure member toward its first position.

2. The electrical connector of claim 1 wherein said pressure member includes an actuating portion having a width sized to fit between the stop means on the opposite sides of the housing.

3. The electrical connector of claim 1, including pivot means rotatably mounting the pressure member on the housing, the pivot means being located rearwardly of said stop means.

4. The electrical connector of claim 3 wherein said pivot means comprise a pair of pivots between opposite sides of the pressure member and said opposite sides of the housing.

5. The electrical connector of claim 1 wherein said overhanging extensions include a lower surface each defining a first and second generally triangular space forming sides of said cable receiving opening.

6. The electrical connector of claim 5 wherein said pressure member includes an angled lower surface defining a third generally triangular space between the pressure member and the flat cable when the pressure member is in the second position, said third triangular space open with the first and second triangular spaces, said lower surface of said overhanging extensions and said angled lower surface of said pressure member generally parallel with one another whereby said cable would contact the lower surface of the overhanging extensions at the same time as said cable contacts the stepped lower surface of said pressure member.

7. An electrical connector for a flat cable, comprising:

a housing mounting a plurality of terminals in a generally parallel array, the housing having a cammed slot in opposite side walls and a front end with an opening between the side walls for receiving an end of the flat cable in engagement with contact portions of the terminals;

a pressure member rotatably mounted on the housing and forced against the cammed slot for movement between a first position allowing insertion of the flat cable into the opening and a second position pressing conductors of the flat cable against the contact portions of the terminals;

a pair of overhanging extensions projecting inwardly from the opposite sides of the housing adapted to engage edges of the end of the flat cable for preventing release of the flat cable from the electrical connector in the event undesired external forces are applied to the cable which would tend to bias the pressure member toward its first position;

said pressure member including an actuating portion having a width sized to fit between the overhanging extensions of the opposite sides of the housing; and pivot means rotatably mounting the pressure member on the housing against said cammed slot, said cammed slot positioned between said front end and said pair of overhanging extensions, the pivot means being located rearwardly of said overhanging extensions.

8. The electrical of claim 7 wherein said pivot means comprise a pair of pivots between opposite sides of the pressure member and said opposite sides of the housing.

9. The electrical corrector of claim 7 wherein said overhanging extensions include a lower surface each defining a first and second generally triangular spaces forming sides of said cable receiving opening and said pressure member includes an angled lower surface defining a third generally triangular space between the pressure member and the flat cable when the pressure member is in the second position said third triangular space open with the first and second triangular spaces, said lower surfaces of said overhanging extensions and said angled lower surface of said pressure member generally parallel with one another whereby said cable would contact the lower surface of the overhanging extensions at the same time as said cable contacts the angled lower surface of said pressure member.

* * * * *